US008875986B2

(12) United States Patent
Stahlecker

(10) Patent No.: US 8,875,986 B2
(45) Date of Patent: Nov. 4, 2014

(54) DOUBLE-WALLED INSULATED CUP OF PAPER MATERIAL AND METHOD FOR THE FABRICATION OF AN INSULATED CUP

(75) Inventor: Werner Stahlecker, Goeppingen (DE)

(73) Assignee: PTM Packaging Tools Machinery Pte. Ltd., Singapore (SG)

( * ) Notice: Subject to any disclaimer, the term of this patent is extended or adjusted under 35 U.S.C. 154(b) by 313 days.

(21) Appl. No.: 13/296,579

(22) Filed: Nov. 15, 2011

(65) Prior Publication Data

US 2012/0118944 A1 May 17, 2012

Related U.S. Application Data

(60) Provisional application No. 61/461,408, filed on Jan. 18, 2011.

(30) Foreign Application Priority Data

Nov. 16, 2010 (DE) ..... 10 2010 044 005

(51) Int. Cl.

| | |
|---|---|
| ***B65D 3/22*** | (2006.01) |
| ***B31B 43/00*** | (2006.01) |
| ***B65D 21/02*** | (2006.01) |
| ***B65D 81/38*** | (2006.01) |

(52) U.S. Cl.

CPC ..... *B65D 81/3869* (2013.01); *B65D 21/0233* (2013.01)

USPC ..... 229/403; 220/62.12; 220/592.2

(58) Field of Classification Search

USPC ..... 229/403; 220/592.17, 592.2, 592.22, 220/62.12, 62.18, 62.2

See application file for complete search history.

(56) References Cited

U.S. PATENT DOCUMENTS 3,908,523 A * 9/1975 Shikaya ..... 493/111
3,927,766 A 12/1975 Day (Continued)

FOREIGN PATENT DOCUMENTS

CN 2618515 Y 6/2004
DE 10 2007 024 243 A1 1/2008

(Continued)

OTHER PUBLICATIONS

Eurasian Patent Office Search Report issued in Eurasian Application No. 201171249/26 mailed Oct. 5, 2012 (2 pages).

(Continued)

*Primary Examiner* — Gary Elkins

(74) *Attorney, Agent, or Firm* — Flynn, Thiel, Boutell & Tanis, P.C.

(57) ABSTRACT

A double-walled insulated cup of paper material having an outer sleeve and an inner cup with a truncated conical wall and a bottom wall interconnected by a peripheral edge frame. The inner cup has a top shoulder and a bottom shoulder and the outside diameter of the inner cup at the level of the top shoulder increases toward the top edge of the inner cup. The outer sleeve lies against the inner cup in the region of the top shoulder thereof and extends to the bottom edge of the peripheral edge frame. The outside diameter of the outer sleeve at the level of the bottom edge of the peripheral edge frame is smaller than the inside diameter of the inner cup just above the bottom shoulder and is greater than the inside diameter of the inner cup just below the bottom shoulder.

19 Claims, 3 Drawing Sheets

(56) References Cited

U.S. PATENT DOCUMENTS

| | | | | |
|---|---|---|---|---|
| 5,226,585 | A * | 7/1993 | Varano | 229/403 |
| 5,460,323 | A * | 10/1995 | Titus | 229/403 |
| 5,697,550 | A * | 12/1997 | Varano et al. | 229/403 |
| 6,193,098 | B1 * | 2/2001 | Mochizuki et al. | 220/592.17 |
| 6,253,995 | B1 | 7/2001 | Blok et al. | |
| 7,451,910 | B2 | 11/2008 | Frost et al. | |
| 7,905,821 | B2 * | 3/2011 | Stahlecker | 493/152 |
| 7,984,846 | B2 | 7/2011 | Messerschmid et al. | |
| 8,387,857 | B2 * | 3/2013 | Messerschmid | 229/403 |
| 2008/0023536 | A1 | 1/2008 | Frost et al. | |
| 2008/0023537 | A1 | 1/2008 | Frost et al. | |
| 2008/0029588 | A1 | 2/2008 | Messerschmid et al. | |
| 2011/0174656 | A1 | 7/2011 | D'Amato | |

FOREIGN PATENT DOCUMENTS

| | | | |
|---|---|---|---|
| EP | 1 785 265 | A1 | 5/2007 |
| JP | 10-278931 | A | 10/1998 |
| JP | 2004-90929 | A | 3/2004 |

OTHER PUBLICATIONS

European Patent Office Search Report issued in European Application No. 11185844.5 dated Feb. 22, 2012 with English translation of categories of cited documents (7 pages).

* cited by examiner

DOUBLE-WALLED INSULATED CUP OF PAPER MATERIAL AND METHOD FOR THE FABRICATION OF AN INSULATED CUP

CROSS-REFERENCE TO RELATED APPLICATIONS

This application claims the benefit of German Application No. 10 2010 044 005.1, filed Nov. 16, 2010, and U.S. Provisional Application No. 61/461 408, filed Jan. 18, 2011, which are hereby incorporated by reference in their entirety.

FIELD OF THE INVENTION

The invention relates to a double-walled insulated cup made of paper material, for example, paper or cardboard, comprising an inner cup having a generally truncated conical wall and a pot-type bottom wall, these being joined together by means of a peripheral edge frame, and further comprising an outer sleeve, the inner cup having a top shoulder in its top half and a bottom shoulder in its bottom half, and the outside diameter of the inner cup at the level of its top shoulder increases toward the top edge of the inner cup, as regarded from the bottom wall of the inner cup.

The invention also relates to a method for the fabrication of a double-walled insulated cup made of paper material.

BACKGROUND OF THE INVENTION

German Laid-open Specification DE 10 2007 024 243 A1 discloses a double-walled insulated cup made of paper material and comprising an inner cup having a generally truncated conical wall and a pot-type bottom wall. The wall and the bottom wall are joined together by means of a peripheral edge frame in a liquid-tight manner. The peripheral edge frame is flared in its bottom region in a direction contrary to that of the truncated conical shape of the inner cup. When a number of cups are stacked together, the bottom edge of the peripheral edge frame of the upper cup can be supported against a bottom shoulder located in the bottom half of the wall of the inner cup. In the top half of the inner cup, a top shoulder can be provided, from which the outside diameter of the inner cup increases up to the top edge of the inner cup, as regarded from the bottom wall of the inner cup. The insulated cup comprises an outer sleeve having a likewise truncated conical wall. The outer sleeve lies against the external wall of the inner cup above the top shoulder thereof and likewise lies against the wall of the inner cup below the bottom shoulder thereof. A roll-in entity that is rolled in toward the inner cup can be provided at the bottom end of the outer sleeve in order to increase the distance between the inner cup and the outer sleeve in this region.

It is an object of the present invention to improve a double-walled insulated cup made of paper material and a method for the fabrication of a double-walled insulated cup.

According to the invention, a double-walled insulated cup made of paper material is provided for this purpose, which cup comprises an inner cup having a generally truncated conical wall and a pot-type bottom wall, these being joined together by means of a peripheral edge frame or skirt, and further comprising an outer sleeve, the inner cup having a top shoulder in its top half and a bottom shoulder in its bottom half, and the outside diameter of the inner cup at the level of its top shoulder increases up to the top edge of the inner cup, as regarded from the bottom wall of the inner cup, and the outer sleeve rests against the inner cup at least in the region of its top shoulder and extends at least to a bottom edge of the peripheral edge frame and lies against the peripheral edge frame at least in the region of the bottom edge thereof, and the outside diameter of the outer sleeve at the level of the bottom edge of the peripheral edge frame is smaller than the inside diameter of the inner cup just above the bottom shoulder and is greater than the inside diameter of the inner cup just below the shoulder.

The invention enables an increased distance to be achieved between the inner cup and the outer sleeve in a double-walled insulated cup, which results in improved insulating properties thereof. The cup has an enhanced appearance, since the outer sleeve extends to the bottom edge of the peripheral edge frame, and the peripheral edge frame and the bottom wall are hidden from view. At the same time, this increases the printable surface of the outer sleeve. Furthermore, the stability of the cup, more specifically, the stability of the peripheral edge frame, can be increased, since the peripheral edge frame is stiffened by the outer sleeve resting against the peripheral edge frame at least in the region of the bottom edge thereof. Furthermore, improved firmness of the base of the cup can be achieved, since a larger amount of formable material is present in the region of the standing area of the cup, and the standing area of the cup is increased. Apart from these advantages, the insulated cup of the invention is capable of being stacked by means of the peripheral edge frame in a well-proven way. The outer sleeve can also be used for stacking the cup in that the outer sleeve rests against the outside of the peripheral edge frame so that the peripheral edge frame need not be flared or need not be flared to any great extent. Finally, the double-walled insulated cup of the invention is easier to fabricate than insulated cups known in the prior art, since the narrow end of the outer sleeve does not have to slide beyond the outer edge of the peripheral edge frame, but can instead rest directly against the same. This considerably facilitates the fabrication of the insulated cup and, more specifically, the process of sliding the outer sleeve over the inner cup.

In a development of the invention, the outer sleeve is wrapped around the bottom edge of the peripheral edge frame.

In this way, the outer sleeve can be attached in a simpler and more stable manner to the peripheral edge frame. The standing area of the insulated cup is thus formed by the bottom edge of the outer sleeve. Such a standing area is larger than the bottom edge of the peripheral edge frame alone so that the insulated cup exhibits improved standing stability.

In a development of the invention, the outer sleeve is attached to an internal surface of the peripheral edge frame. In this way, the join between the outer sleeve and the peripheral edge frame is hidden from view. For example, the outer sleeve is sealed or glued to the internal surface of the peripheral edge frame. Only the outer sleeve extending down to the bottom edge of the cup is then visible on the outside of the peripheral edge frame. The outer sleeve need not rest against an external surface of the peripheral edge frame so that a cup having a very pleasing shape is produced, because the outer sleeve has a continuous truncated conical shape extending from its top end below a mouth bead down to the bottom end. An outer sleeve of such shape is, furthermore, easy to print on.

In a development of the invention, the outer sleeve is attached to the inner cup in the region of the top shoulder.

In this way, the outer sleeve can be attached easily to the inner cup, and the outer sleeve is thus held at a distance from the inner cup between the top shoulder and the bottom edge of the peripheral edge frame such that satisfactory insulating properties can be achieved.

In a development of the invention, the outer sleeve has a truncated conical shape and extends from an underside of a mouth bead disposed on the inner cup down to the bottom edge of the peripheral edge frame.

In this way, an insulated cup having a very pleasing shape is provided that has, at the top edge thereof, the mouth bead of the inner cup and, below the mouth bead, the outer sleeve. The outer sleeve has a continuous truncated conical shape extending down to the bottom edge of the cup.

In a development of the invention, the outer sleeve rests flat against the peripheral edge frame at least partially in a contact region that extends upwardly from the bottom edge of the peripheral edge frame.

In this way, the outer sleeve can be joined very securely to the peripheral edge frame by means of its flat contact therewith. The outer sleeve can rest flat either against an external surface of the peripheral edge frame or against an internal surface thereof, after the outer sleeve has been wrapped. The outer sleeve and the peripheral edge frame can be joined together by means of a heat seal or glue or a hot-melt adhesive, for example.

In a development of the invention, the outside diameter of the outer sleeve in a retracted region located above the contact region decreases more sharply than the taper of the truncated conical outer sleeve above the retracted region.

In this way, the inside and outside diameters of the outer sleeve above the region, in which the outer sleeve rests against the outside of the peripheral edge frame, can be more sharply tapered than those of the truncated conical shape of the outer sleeve. In this way, a comparatively large distance ensuring satisfactory insulating properties can be maintained between the outer sleeve and the inner cup up to just above the contact region.

In a development of the invention, the outer sleeve rests flat against the inner cup in a region extending from the top shoulder of the inner cup up to the underside of a mouth bead disposed at the top end of the inner cup.

In this way, the outer sleeve can also be attached very securely to the inner cup in the top region of the same. The top shoulder can serve as a filling mark for the cup so that there is not normally any liquid located above the top shoulder, and thus the reduced insulating properties in this region due to the lack of an air gap between the outer sleeve and the inner cup do not constitute a disadvantage.

The object of the invention is also achieved by a method for the fabrication of a double-walled insulated cup made of paper material, which method includes the following steps:

- fabricating an inner cup having a generally truncated conical wall and a pot-type bottom wall, these being joined together by means of a peripheral edge frame,
- fabricating a generally truncated conical outer sleeve by joining together the longitudinal edges of a blank for the outer sleeve,
- sliding the outer sleeve over the inner cup in a direction extending from the bottom wall of the inner cup toward the wide end of the inner cup, and
- attaching the narrow end of the outer sleeve to the peripheral edge frame of the inner cup.

The fabrication of the insulated cup can be facilitated by prefabricating the outer sleeve from a blank shaped as a circular ring segment to form a truncated conical sleeve, and by sliding it in this truncated conical state over the inner cup proceeding from the bottom wall thereof. Fitting the outer sleeve is particularly facilitated on account of the fact that the narrow end of the inner cup need not slide beyond the peripheral edge frame, but rather the narrow end of the outer sleeve is attached to the peripheral edge frame of the inner cup itself. The narrow end of the outer sleeve and the peripheral edge frame are readily accessible for this purpose.

In a development of the invention, the narrow end of the outer sleeve is attached to the peripheral edge frame by wrapping the narrow end around the bottom edge of the peripheral edge frame.

In this way, a very stable join between the outer sleeve and the peripheral edge frame can be achieved. If the join between the outer sleeve and the peripheral edge frame, achieved by a simple wrapping process, namely by non-positively joining the peripheral edge frame to the outer sleeve, is not sufficiently stable, the outer sleeve and the peripheral edge frame can be additionally attached to the internal and/or external surface of the peripheral edge frame by means of a heat seal, glue or a hot-melt adhesive. For example, the outer sleeve can be joined, at least partially, to an external and/or internal surface of the peripheral edge frame after the narrow end of the outer sleeve has been wrapped around the bottom edge of the peripheral edge frame.

In a development of the invention, the outer sleeve is slid over the inner cup until a bottom edge of the outer sleeve is at the level of the bottom edge of the peripheral edge frame, and the narrow end of the outer sleeve is attached to the peripheral edge frame by joining the internal surface at the bottom edge of the outer sleeve to the external surface of the peripheral edge frame.

In this way, the outer sleeve can be attached securely to the peripheral edge frame without requiring the narrow end of the outer sleeve to be wrapped around the peripheral edge frame.

Additional features and advantages of the invention are revealed in the claims and in the following description of preferred embodiments of the invention, with reference to the drawings. Individual features of the different embodiments shown and described can be arbitrarily combined with each other, as required, without going beyond the scope of the present invention.

DETAILED DESCRIPTION

Figure 1:
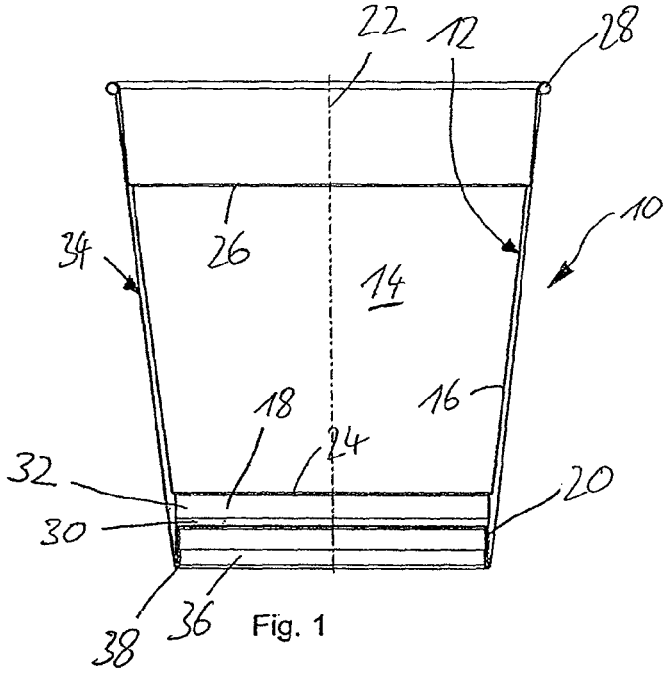
FIG. 1 is a cross-sectional view of an insulated cup of the invention according to a first embodiment.

FIG. 1 is a cross-sectional view of a double-walled insulated cup 10 according to a first embodiment of the invention. The insulated cup 10 is provided with an inner cup 12 that delimits a fillable interior chamber 14 and comprises a generally truncated conical wall 16 and a bottom wall 18. The bottom wall 18 is pot-shaped and is positioned at the bottom narrow end of the truncated conical wall 16 such that its open side is remote from the interior chamber 14. The wall 16 and the bottom wall 18 are joined together by means of a skirt or edge frame 20.

Figure 2:
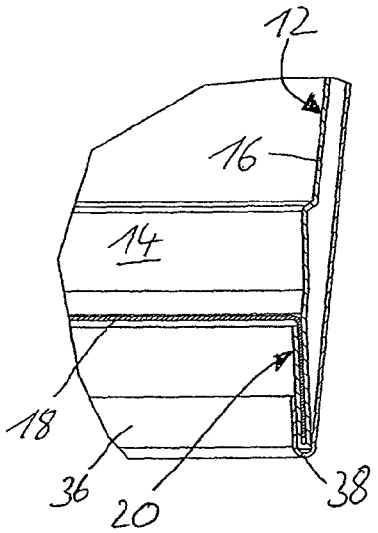
FIG. 2 is a partial enlargement of the view shown in FIG. 1.

The shape of the peripheral edge frame 20 can be seen in FIG. 2. The bottom end of the truncated conical wall 16 is wrapped around the bottom end of the edge of the pot-type bottom wall 18, and both the portion of the wall 16 resting externally against the edge of the bottom wall 18 in the right half of FIG. 2 and the portion of the wall 16 located internally in the left half of FIG. 2 are joined to the edge of the bottom wall 18 and they thus form the peripheral edge frame 20. For example, the wall 16 and the bottom wall 18 can be joined by means of heat sealing. In order to protect the paper material, for example cardboard or thick paper, constituting the material of the bottom wall 18 and the wall 16, from the entry of liquid, at least the internal surface of the wall 16 and the top face of the bottom wall 18 are provided with a hot-sealable plastics layer. After the bottom edge of the wall 16 has been wrapped around the edge of the bottom wall as shown in FIG. 2, the wall 16 can then be heat sealed to one or both sides of the edge of the pot-type bottom wall 18.

As can be seen from FIG. 2 and from FIG. 1, the peripheral edge frame 20 is slightly flared outwardly in relation to the longitudinal center axis 22 of the insulated cup 10. Thus the diameter of the inner cup 12 increases slightly from the portion of the bottom wall 18 delimiting the interior chamber 14 to the bottom edge of the peripheral edge frame.

It can further be seen from FIG. 1 that the inner cup 12 comprises a peripheral bottom shoulder 24 in the bottom half of the interior chamber 14 thereof, and a peripheral top shoulder 26 in the top half of the interior chamber 14 of the inner cup 12. The inner cup 12 is further provided with a peripheral mouth bead 28 at its top wide end. The peripheral top shoulder 26 can serve as a filling mark in order to indicate the correct filling level for the liquid to be present in the interior chamber 14.

Starting from the bottom wall 18 and proceeding toward the open end of the inner cup 12 surrounded by the mouth bead 28, the inside diameter of the inner cup 12 increases initially in a region 30, followed by a cylindrical region 32 extending to the peripheral shoulder 24. The inside diameter of the inner cup 12 increases abruptly at the peripheral shoulder 24. The wall 16 of the inner cup 12 extends at a constant cone angle from above the bottom shoulder 24 up to the top shoulder 26. The wall 16 of the inner cup 12 again has an abruptly increased diameter at the top shoulder 26, to then reassume a constant cone angle from the top shoulder 26 to just below the mouth bead 28, which cone angle is somewhat smaller than the cone angle between the bottom shoulder 24 and the top shoulder 26. The bottom peripheral shoulder 24 serves as a means for supporting a stacked cup, as explained below with reference to FIG. 4. Apart from its function as a filling mark, the top shoulder 26 is provided for the purpose of forming an air gap having an insulating effect between the outer sleeve 34 and the wall 16 of the inner cup 12.

The outer sleeve 34 has a truncated conical shape and a cone angle that is constant from its top edge 40, which is adjacent to the underside of the mouth bead 28, to the bottom edge of the peripheral edge frame 20. In the embodiment shown, the cone angle of the outer sleeve 34 is the same as the cone angle of the wall 16 of the inner cup 12 between the bottom shoulder 24 and the top shoulder 26 so that an air gap between the inner cup 12 and the outer sleeve 34 has a constant width between the bottom shoulder 24 and the top shoulder 26.

At its bottom narrow end, the outer sleeve 34 is wrapped around the bottom edge of the peripheral edge frame 20, and a peripheral region 36 of the outer sleeve 34 rests flat against an internal surface of the peripheral edge frame 20. This region 36 is shorter than the peripheral edge frame 20. The region 36 rests flat against the peripheral edge frame 20 and can additionally be joined to the same, for example by means of a heat seal, glue, a hot-melt adhesive, or the like.

In the region of it bottom edge 38, the outer sleeve 34 forms the standing area of the insulated cup 10.

In the region of the top shoulder 26, the outer sleeve 34 rests against the wall 16 of the inner cup 12. If required, the outer sleeve 34 can, for reasons of stability, be joined to the inner cup 12 in this region, for example by means of a heat seal, glue or a hot-melt adhesive. The outer sleeve 34 is again slightly spaced from the inner cup 12 just below the mouth bead 28 due to the cone angle of the outer sleeve 34 between the top shoulder 26 and the mouth bead 28 being slightly larger than the cone angle of the inner cup 12. As can be seen from FIG. 1, the outer sleeve 34 has a constant cone angle from its top end located below the mouth bead 28 to the bottom edge 38. Thus the outer sleeve 34 provides a flat, readily printable region over substantially the entire height of the cup.

Figure 3:
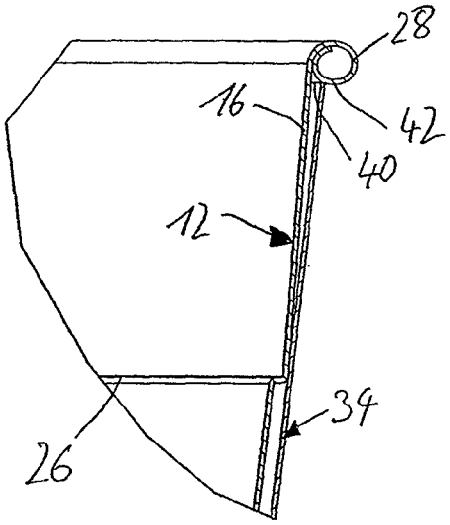
FIG. 3 is a further partial enlargement of the view shown in FIG. 1.

An enlarged partial view of the top region of the insulated cup 10 is shown in FIG. 3.

It can be seen from FIG. 3 that the top edge 40 of the outer sleeve 34 is disposed between the lowest point 42 of the underside of the mouth bead 28 and the wall 16 of the inner cup 12. Thus the top edge 40 of the outer sleeve 34 is prevented from sliding down beyond the lowest point 42 of the mouth bead 28.

Figure 4:
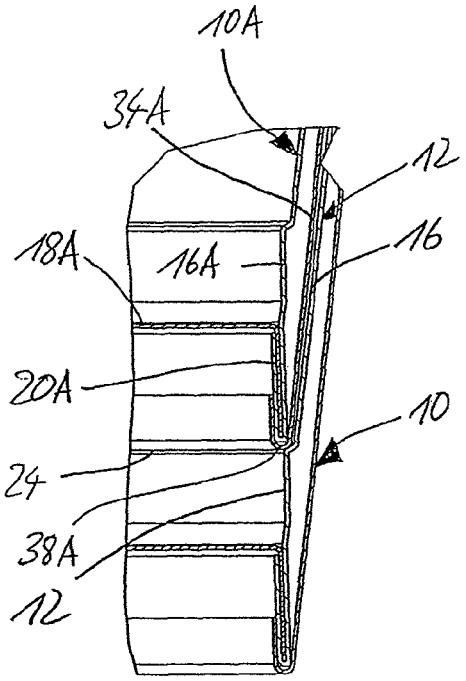
FIG. 4 is a partial illustration of two stacked insulated cups as shown in FIG. 1.

FIG. 4 partially illustrates two stacked double-walled insulated cups 10 and 10A. The top insulated cup 10A in FIG. 4 rests by means of its bottom edge defined by the edge 38A of its wrapped outer sleeve 34A against the bottom peripheral shoulder 24 of the inner cup 12 of the bottom insulated cup 10. Since the outer sleeve 34A rests against the outside of the peripheral edge frame 20A and is then wrapped around the bottom edge of the peripheral edge frame 20A, the peripheral edge frame 20A must be flared out to a lesser extent than would be the case without the outer sleeve 34A, in order to enable the upper cup to be safely stacked on the bottom shoulder 24 of the lower cup 10. The outside diameter of the outer sleeve 34A at its bottom edge 38A is slightly smaller than the inside diameter of the inner cup 12 just above the bottom shoulder 24, but is greater than the inside diameter of the inner cup 12 just below the bottom shoulder 24. The bottom edge 38A of the upper cup 10A rests at least partially on the bottom shoulder 24 of the lower cup 10 so that several cups 10, 10A can be safely stacked. At the same time, the outer sleeve 34A of the upper cup 10A is spaced slightly from the inner wall 16 of the lower cup 10 so that an exchange of air can take place when the cups 10, 10A are stacked and unstacked, so that the cups 10, 10A do not become sucked one inside the other.

When several cups 10, 10A are stacked together, considerable forces are applied to the bottom edge 38A, for example when such a stack of cups is placed on a surface. In the cup of the invention, this bottom edge 38A is stabilized not only by the peripheral edge frame 20A but also by the outer sleeve 34A. Compared with conventional cups, it is therefore possible to reduce the material thickness of the outer sleeve 34A, the bottom wall 18A, and the wall 16A and still maintain sufficient stability in this bottom region.

As can be seen from FIG. 4, the wall 16 of the inner cup 12 of the bottom insulated cup 10 and the outer sleeve 34A of the top insulated cup 10A extend parallel to each other and at a small distance from each other, above the bottom shoulder 24.

Figure 5:
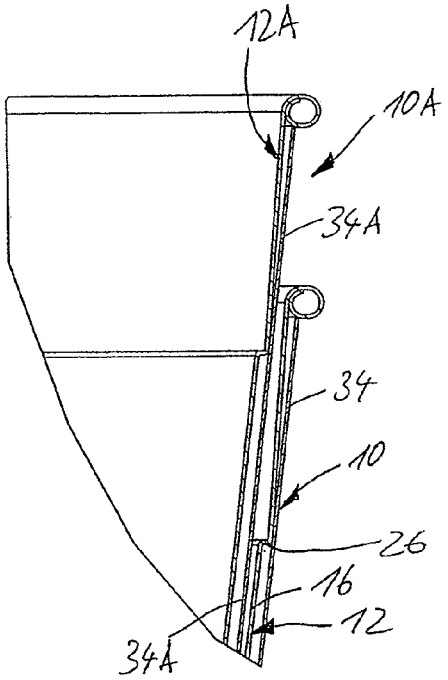
FIG. 5 is a further partial illustration of two stacked insulated cups as shown in FIG. 1.

FIG. 5 shows a top region of the two stacked insulated cups 10A and 10. It can be seen that the outer sleeve 34A of the upper cup 10A and the wall 16 of the inner cup 12 of the lower cup 10 extend parallel to each other only as far as the top shoulder 26 of the bottom insulated cup 10.

The outer sleeves 34A and 34 are made of slightly thinner paper material than the inner cups 12A and 12 respectively.

Figure 7:
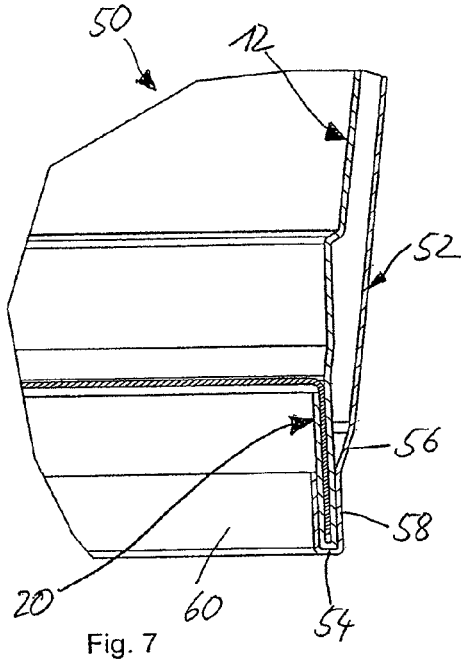
FIG. 7 shows a partial enlargement of the view shown in FIG. 6.
Figure 6:
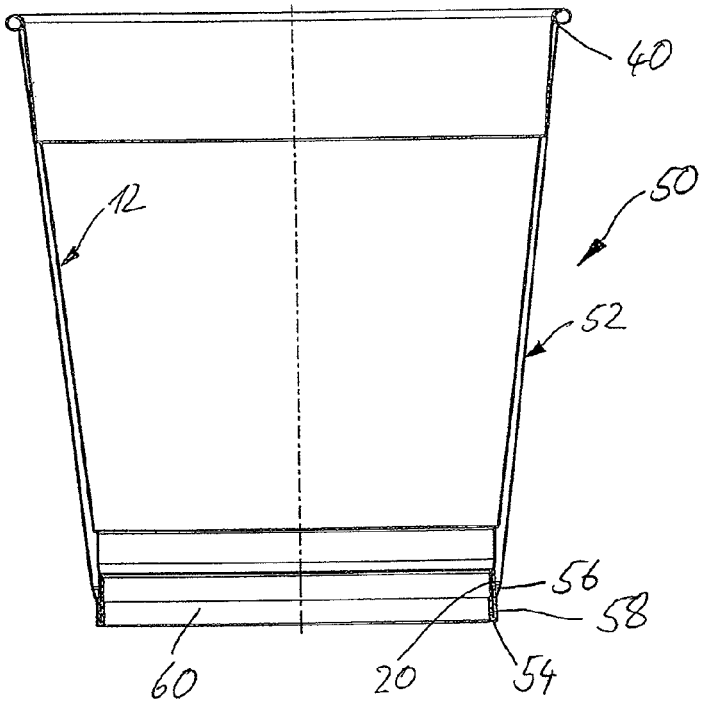
FIG. 6 shows an insulated cup of the invention according to a second preferred embodiment.

FIG. 6 and FIG. 7 are cross-sectional views of a double-walled insulated cup 50 of the invention according to a further preferred embodiment of the invention. The insulated cup 50 differs from the insulated cup 10 shown in FIG. 1 only in terms of a minority of features so that only the differing features are explained below.

In particular, the insulated cup 50 comprises an inner cup 12 that is identical to the inner cup 12 of the insulated cup 10 shown in FIG. 1. But the outer sleeve 52 is retracted in a region 56 above its bottom edge 54 so that a greater cone angle is formed in the region 56 than between the region 56 and the top edge 40 of the outer sleeve 52. As regarded downwardly from the top edge 40, the region 56 is followed by a contact region 58, in which the outer sleeve 52 rests flat against the external surface of the peripheral edge frame 20 of the inner cup 12. The bottom end of the outer sleeve 52 is wrapped around the peripheral edge frame 20 so that a region 60 of the outer sleeve 52 again rests flat against the internal surface of the peripheral edge frame 20. The outer sleeve 52 can be attached to the peripheral edge frame 20, for example by means of a heat seal, glue or a hot-melt adhesive in the regions 58, 60 that rest flat against the peripheral edge frame 20.

The retracted region 56 and the two regions 58, 60 of the outer sleeve 52 resting flat against the peripheral edge frame 20 enable the outer sleeve 52 to be joined particularly securely to the peripheral edge frame 20 of the inner cup 12.

Figure 8:
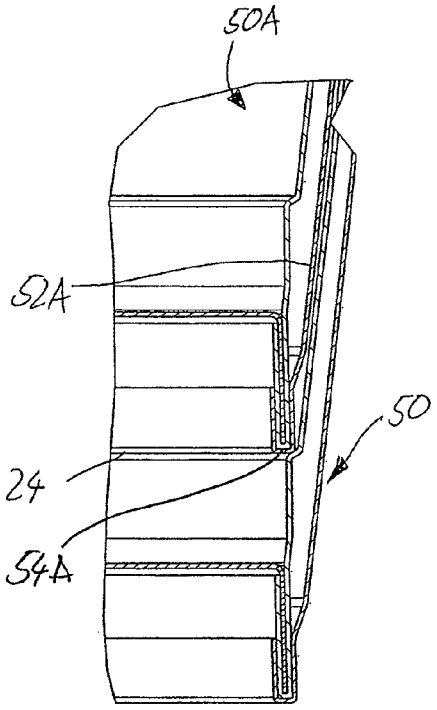
FIG. 8 is a partial view of two stacked insulated cups as shown in FIG. 6.

FIG. 8 is a partial view of two stacked double-walled insulated cups 50 and 50A. In a manner similar to the insulated cups 10, 10A shown in FIG. 4, an outwardly located region, as regarded in the radial direction, of the bottom edge 54A of the outer sleeve 52A of the upper cup 50A, is implemented for resting on the bottom shoulder 24 of the lower cup 50 and thus for absorbing the stacking loads.

Figure 9:
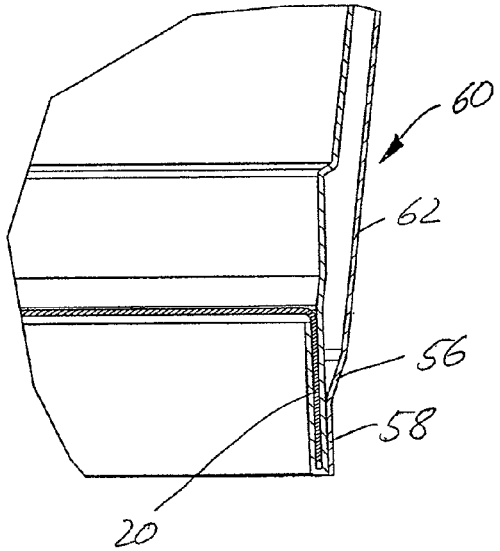
FIG. 9 is a partial illustration of an insulated cup of the invention according to a third preferred embodiment.

FIG. 9 is a partial view of a double-walled insulated cup 60 according to a further preferred embodiment of the invention. The insulated cup 60 differs only slightly from the insulated cup 50 shown in FIG. 6 so that only the differing features are explained below.

Unlike the insulated cup 50 shown in FIG. 6, an outer sleeve 62 of the insulated cup 60 is not wrapped around the bottom edge of the peripheral edge frame 20 but instead it terminates at the level of the bottom edge of the peripheral edge frame 20. The outer sleeve 62 is likewise provided with a retracted region 56 and a region 58 that rests flat against an external surface of the peripheral edge frame 20. The outer sleeve 62 can be joined to the peripheral edge frame 20, for example by means of a heat seal, glue, or a hot-melt adhesive, in this region 58 lying flat against the external surface of the peripheral edge frame.

Figure 10:
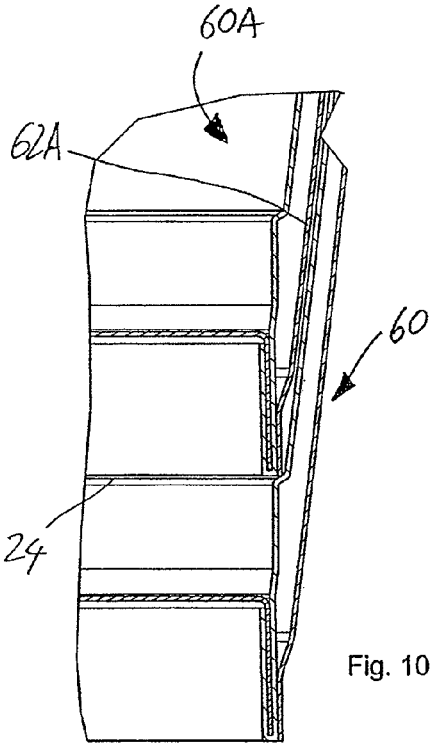
FIG. 10 is a partial view of two stacked insulated cups as shown in FIG. 9.

FIG. 10 is a partial view of two stacked insulated cups 60, 60A. The cups are stacked together with the bottom edge of the outer sleeve 62A of the upper cup 60A resting on the bottom shoulder 24 of the lower cup 60.

Figure 11:
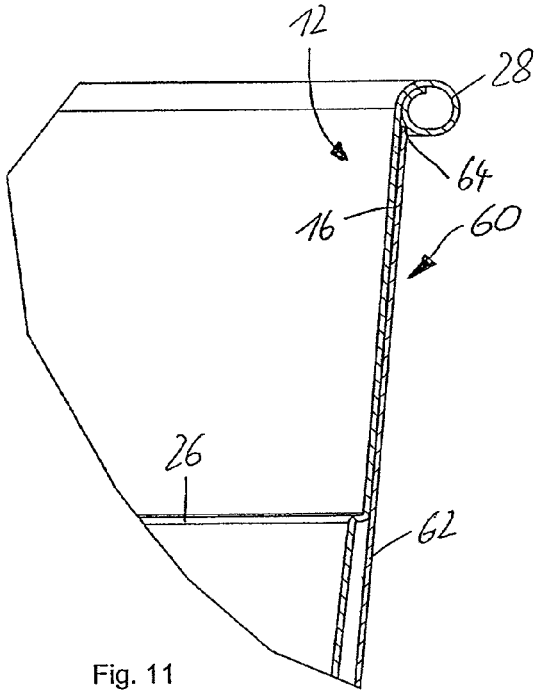
FIG. 11 is a partial view of the insulated cup shown in FIG. 9.

FIG. 11 is a partial view of a top region of the insulated cup 60 shown in FIG. 9. It can be seen that the outer sleeve 62 lies flat against the external surface of the inner cup 12 in a region located between the top shoulder 26 and the mouth bead 28 of the inner cup 12. The top edge 64 of the outer sleeve 62 is thus jammed between the mouth bead 28 and the wall 16 of the inner cup 12 and therefore fixed in this position. If it is still desired to additionally fix the outer sleeve 62 to the inner cup 12, this can be carried out by means of a heat seal, glue or a hot-melt adhesive in the region located directly on or above the top shoulder 26. The outer sleeve 62 and the wall 16 of the inner cup 12 are located close together in this region.

The invention claimed is:

1. A double-walled insulated cup of paper material, comprising an inner cup having a generally truncated conical wall and a pot-type bottom wall, said conical wall and said bottom wall being interconnected by a peripheral edge frame, and further comprising an outer sleeve, wherein said inner cup has a top shoulder in a top half of said inner cup and a bottom shoulder in a bottom half of said inner cup, wherein an outside diameter of said inner cup at a level of said top shoulder increases toward a top edge of said inner cup as regarded from said bottom wall of said inner cup, wherein said outer sleeve rests against said inner cup at least in a region of said top shoulder thereof, wherein said outer sleeve extends at least down to a bottom edge of said peripheral edge frame and lies against the peripheral edge frame at least in a region of the bottom edge of said peripheral edge frame, and wherein an outside diameter of said outer sleeve at a level of the bottom edge of said peripheral edge frame is smaller than an inside diameter of said inner cup just above said bottom shoulder and is greater than an inside diameter of said inner cup just below said bottom shoulder, and wherein the peripheral edge frame continuously widens in a direction away from the bottom wall down to the bottom edge of the peripheral edge frame.

2. The double-walled insulated cup as defined in claim 1, wherein said outer sleeve is wrapped around the bottom edge of said peripheral edge frame.

3. The double-walled insulated cup as defined in claim 2, wherein said outer sleeve is attached to an internal surface of said peripheral edge frame.

4. The double-walled insulated cup as defined in claim 1, wherein said outer sleeve is attached to said inner cup in the region said top shoulder.

5. The double-walled insulated cup as defined in claim 1, wherein said outer sleeve has a truncated cone shape and extends from an underside of a mouth bead Idisposed on said inner cup down to the bottom edge of said peripheral edge frame.

6. The double-walled insulated cup as defined in claim 1, wherein said outer sleeve lies flat against said peripheral edge frame at least partially in a contact region, which contact region extends upwardly from the bottom edge of said peripheral edge frame.

7. The double-walled insulated cup as defined in claim 6, wherein the outside diameter of said outer sleeve in a retracted region located above said contact region decreases more sharply than a taper of said outer sleeve above said retracted region.

8. The double-walled insulated cup as defined in claim 1, wherein said outer sleeve lies substantially flat against said inner cup in a region extending from said top shoulder of said inner cup up to an underside of a mouth bead disposed at a top end of said inner cup.

9. The double-walled insulated cup as defined in claim 1, wherein an angle of inclination of the peripheral edge frame is constant from the bottom wall to the bottom edge of the peripheral edge frame.

10. The double-walled insulated cup as defined in claim 9, wherein the outer sleeve is folded around the bottom edge of the peripheral edge frame.

11. A method for fabrication of a double-walled insulated cup of paper material comprising: fabricating an inner cup having a generally truncated conical wall and a pot-type bottom wall, attaching the generally truncated conical wall and the bottom wall to each other by of a peripheral edge frame, fabricating a generally truncated conical outer sleeve by joining longitudinal edges of a blank for said outer sleeve, sliding said outer sleeve onto said inner cup in a direction extending from said bottom wall of said inner cup to a wide end of said inner cup, and attaching a narrow end of said outer sleeve to the peripheral edge frame of said inner cup, wherein the peripheral edge frame continuously widens in a direction away from the bottom wall down to a bottom edge of the peripheral edge frame.

12. The method as defined in claim 11, wherein the narrow end of said outer sleeve is attached to said peripheral edge frame by wrapping the narrow end around the bottom edge of said peripheral edge frame.

13. The method as defined in claim 12, wherein following of wrapping said narrow end of said outer sleeve, attaching said outer sleeve at least partially to an external surface and/or to an internal surface of said peripheral edge frame.

14. The method as defined in claim 11, wherein said outer sleeve is slid onto said inner cup until a bottom edge of said outer sleeve is at a level of the bottom edge of said peripheral edge frame and wherein the narrow end of said outer sleeve is attached to said peripheral edge frame by joining an internal surface at the bottom edge of said outer sleeve to an external surface of said peripheral edge frame.

15. The method as defined in claim 11, wherein an angle of inclination of the peripheral edge frame is constant from the bottom wall to the bottom edge of the peripheral edge frame.

16. The method as defined in claim 11, further including folding the outer sleeve around the bottom edge of the peripheral edge frame.

17. A double-walled insulated cup of paper material, comprising an inner cup having a generally truncated conical wall and a pot-type bottom wall, said conical wall and said bottom wall being interconnected by a peripheral edge frame, and further comprising an outer sleeve, wherein said inner cup has a top shoulder in a top half of said inner cup and a bottom shoulder in a bottom half of said inner cup, wherein an outside diameter of said inner cup at a level of said top shoulder increases toward a top edge of said inner cup as regarded from said bottom wall of said inner cup, wherein said outer sleeve rests against said inner cup at least in a region of said top shoulder thereof, wherein said outer sleeve extends at least down to a bottom edge of said peripheral edge frame and lies against the peripheral edge frame at least in a region of the bottom edge of said peripheral edge frame, and wherein an outside diameter of said outer sleeve at a level of the bottom edge of said peripheral edge frame is smaller than an inside diameter of said inner cup just above said bottom shoulder and is greater than an inside diameter of said inner cup just below said bottom shoulder, and wherein the peripheral edge frame continuously widens in a direction away from the bottom wall down to the bottom edge of the peripheral edge frame, wherein an angle of inclination of the peripheral edge frame is constant from the bottom wall to the bottom edge of the peripheral edge frame.

18. The double-walled insulated cup as defined in claim 17, wherein the outer sleeve is folded around the bottom edge of the peripheral edge frame.

19. A double-walled insulated cup of paper material, comprising an inner cup having a generally truncated conical wall and a pot-type bottom wall, said conical wall and said bottom wall being interconnected by a peripheral edge frame, and further comprising an outer sleeve, wherein said inner cup has a top shoulder in a top half of said inner cup and a bottom shoulder in a bottom half of said inner cup, wherein an outside diameter of said inner cup at a level of said top shoulder increases toward a top edge of said inner cup as regarded from said bottom wall of said inner cup, wherein said outer sleeve rests against said inner cup at least in a region of said top shoulder thereof, wherein said outer sleeve extends at least down to a bottom edge of said peripheral edge frame and lies against the peripheral edge frame at least in a region of the bottom edge of said peripheral edge frame, and wherein an outside diameter of said outer sleeve at a level of the bottom edge of said peripheral edge frame is smaller than an inside diameter of said inner cup just above said bottom shoulder and is greater than an inside diameter of said inner cup just below said bottom shoulder, and wherein the peripheral edge frame continuously widens in a direction away from the bottom wall down to the bottom edge of the peripheral edge frame, wherein the outer sleeve is folded around the bottom edge of the peripheral edge frame.

* * * * *